US005192646A

United States Patent [19]

Merkel et al.

[11] Patent Number: 5,192,646

[45] Date of Patent: Mar. 9, 1993

[54] PHOTOGRAPHIC ELEMENTS HAVING SULFOXIDE COUPLER SOLVENTS AND ADDENDA TO REDUCE SENSITIZING DYE STAIN

[75] Inventors: Paul B. Merkel, Rochester; Edward Schofield; Tienteh Chen, both of Penfield, all of N.Y.

[73] Assignee: Eastman Kodak Company, Rochester, N.Y.

[21] Appl. No.: 804,787

[22] Filed: Dec. 9, 1991

[51] Int. Cl.[5] ..... G03C 1/38

[52] U.S. Cl. ..... 430/377; 430/546; 430/384; 430/385; 430/388; 430/389

[58] Field of Search ..... 430/377, 546, 553, 384, 430/385, 388, 389

[56] References Cited

U.S. PATENT DOCUMENTS

| | | | |
|---|---|---|---|
| 3,050,394 | 8/1962 | Ben-Ezra et al. | 430/546 |
| 3,764,336 | 10/1973 | Nittel et al. | 430/546 |
| 4,419,439 | 12/1983 | Kuwazima et al. | 430/377 |
| 4,557,999 | 12/1985 | Aoki et al. | 430/385 |
| 4,774,166 | 9/1989 | Sasaki et al. | 430/384 |
| 4,840,878 | 6/1989 | Hirose et al. | 430/377 |
| 4,988,614 | 1/1991 | Ishige et al. | 430/553 |
| 5,019,490 | 5/1991 | Kobyashi et al. | 430/553 |

*Primary Examiner*—Charles L. Bowers, Jr.
*Assistant Examiner*—Mark F. Huff
*Attorney, Agent, or Firm*—Foley & Lardner

[57] ABSTRACT

A method of forming color in a silver halide photographic element wherein the silver halide is sensitized with a dye involves reacting an oxidized developing agent with a phenol or naphthol cyan dye-forming coupler or an acylacetamide yellow dye-forming coupler in a sulfoxide coupler solvent. The sulfoxide solvent reduces sensitizer dye staining with the cyan or yellow dye-forming coupler in processed photographic materials (films and papers) due to retained sensitizing dye.

31 Claims, No Drawings

PHOTOGRAPHIC ELEMENTS HAVING SULFOXIDE COUPLER SOLVENTS AND ADDENDA TO REDUCE SENSITIZING DYE STAIN

TECHNICAL FIELD

This invention relates to coupler compositions used in silver halide photographic films, particularly to color photographic films which utilize coupler solvents or addenda in combination with sensitizing dyes.

BACKGROUND ART

Processed photographic films and papers which utilize a coupler and a sensitizing dye tend to retain the dye, resulting in staining. This staining tends to be particularly severe with couplers that contain phenol groups or other strong hydrogen bond donor groups. High levels of staining can result in processed papers and reversal films which are visually objectionable, and in negative films with inferior printing characteristics. Consequently, the need exists to identify compositions and methods to reduce retained sensitizing dye and the associated stain.

Sulfoxide groups have been used as coupler substituents. See, for example, Aoki et al. U.S. Pat. No. 4,557,999, issued Dec. 10, 1985, and Sasaki et al. U.S. Pat. No. 4,774,166, issued Sep. 27, 1989. The latter patent also describes sulfoxide-substituted non-coloring phenol compounds.

Use of sulfoxide coupler solvents in combination with couplers is uncommon. U.S. Pat. No. 4,113,488 mentions the use of specific sulfoxides in combination with phenols to improve the light stability of pyrazolone magenta couplers. U.S. Pat. No. 4,419,431 mentions the use of sulfoxides, among other addenda, to improve the light stability of azo dye images.

In commonly-assigned related applications, sulfoxides have been proposed for use in combination with pyrazolotriazole magenta couplers to provide improved photographic speed (U.S. Ser. No. 07/678,427, filed Apr. 1, 1991) and with pyrazolone magenta couplers to provide reduced continued coupling (U.S. Ser. No. 07/689,436, filed Apr. 23, 1991.) Despite the occasional use of sulfoxides in connection with couplers, no reference is made to additional specific coupler solvent-coupler combinations which significantly reduce staining by residual sensitizing dye.

DISCLOSURE OF INVENTION

The invention provides a method of forming color in a silver halide photographic element wherein the silver halide is sensitized with a dye. An oxidized developing agent is reacted with a cyan or yellow dye-forming coupler in a sulfoxide coupler solvent. When the cyan or yellow dye-forming coupler is used, the sulfoxide solvent reduces sensitizer dye staining in processed photographic materials (films and papers) due to retained sensitizing dye.

A coupler composition according to the invention, which may be employed in a developer or as part of a photosensitive element, preferably comprises a phenol or naphthol cyan dye-forming coupler, or an acylacetamide yellow dye-forming coupler, in a solvent comprising a sulfoxide, alone or in combination with one or more organic cosolvents. Such a composition can be used to make a photosensitive element comprising a layer of a silver halide photosensitive emulsion disposed on a support in combination with a dye-forming coupler. As is well known, the coupler reacts with an oxidized developing agent such as a p-phenylenediamine derivative to form a colored image which corresponds to a pattern of exposure of the silver halide. According to the invention, the silver halide is sensitized with a dye, and the photosensitive layer contains a phenolic, naphtholic or acylacetamide coupler in a sulfoxide solvent effective for reducing staining caused by the dye.

MODES FOR CARRYING OUT THE INVENTION

Sulfoxide compounds useful for the practice of this invention are of the following formula:

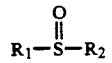

wherein $R_1$ and $R_2$ are individually selected from the group consisting of straight and branched chain alkyl groups, alkylene groups and alkenyl groups, any of which may be substituted with one or more substituents selected from the group consisting of alkoxy, aryloxy, aryl, alkoxycarbonyl, aryloxycarbonyl, acyloxy, carbonamido and carbamoyl groups, and halogen atoms; a phenyl group; and a phenyl group having at least one substituent selected from alkyl, alkoxy, aryloxy, aryl, alkoxycarbonyl, aryloxycarbonyl, acyloxy, carbonamido and carbamoyl groups and halogen atoms; and wherein $R_1$ and $R_2$ combined have at least 12 carbon atoms, preferably from 12 to 26 carbon atoms. In preferred embodiments, $R_1$ and $R_2$ are individually selected from unsubstituted straight and branched chain alkyl groups, alkenyl groups and alkylene groups.

The sulfoxide compound employed in the coupler compositions of the invention may act as a solvent for the dye-forming coupler. One or more additional organic (and preferably non-volatile, high boiling) solvents for the coupler compound may also be employed in the compositions of the invention. Generally, conventional organic coupler solvents such as those described in *Research Disclosure*, December, 1989, Item 308119, page 993, are known in the art and may be employed when the sulfoxide compound of the invention is used in an additive amount which is not sufficient to result in a solution of the coupler compound. Illustrative organic solvents are described in the examples below.

The sulfoxide compound is employed in the coupler compositions of the invention in an amount sufficient to reduce sensitizing dye stain. In most applications, it is preferred that the dye-forming coupler and the sulfoxide compound are employed in a weight ratio of from about 1:0.1 to about 1:10. A preferred coupler coating composition according to the invention may contain weight ratios of coupler to sulfoxide of from 1:0.2 to 1:5 and of sulfoxide to optional coupler solvent of from 1:0 to 1:5.

Suitable sulfoxide compounds for use in the coupler compositions of the invention include, but are not limited to, the following:

$$\text{n-}C_7H_{15}S(=O)C_7H_{15}\text{-n} \qquad \text{I}$$

$$CH_3(CH_2)_3CH(C_2H_5)CH_2S(=O)CH_2CH(C_2H_5)(CH_2)_3CH_3 \qquad \text{II}$$

$$\text{n-}C_9H_{19}S(=O)C_9H_{19}\text{-n} \qquad \text{III}$$

-continued $C_2H_5S(=O)C_{16}H_{33}$-n IV $CH_3(CH_2)_4C(CH_3)_2CH_2S(=O)CH_2C(CH_3)_2(CH_2)_4CH_3$ V $CH_3S(=O)CH_2CH(C_6H_{13}$-n$)C_8H_{17}$-n VI

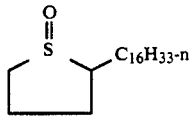

VII

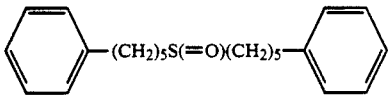

VIII

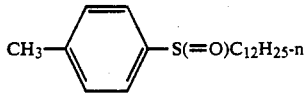

IX

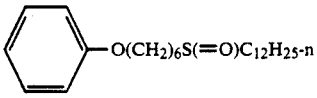

X $CH_3S(=O)(CH_2)_{16}C(=O)N(C_4H_9)_2$ XI $C_8H_{17}S(=O)(CH_2)_{12}OC(=O)CH_3$ XII

As noted above, it is preferred that the dye-forming coupler included in the present coupler compositions comprises a cyan-forming coupler or a yellow dye-forming coupler. Couplers which form cyan dyes upon reaction with oxidized color developing agents are well known in the art and are described in such representative patents and publications as: U.S. Pat. Nos. 2,772,162; 3,476,563; 4,526,864; 4,500,635; 4,254,212; 4,296,200; 4,457,559; 2,895,826; 3,002,836; 3,034,892; 2,474,293; 2,801,171; 2,423,730; 2,367,531; 3,041,236; 4,443,536; 4,333,999; 4,124,396; 4,775,616; 3,779,763; 3,772,002; 3,419,390; 4,690,889; 3,996,253 and "Farbkuppler-eine Literaturübersicht," published in Agfa Mitteilungen, Band III, pp. 156–175 (1961), the disclosures of which are incorporated herein by reference.

In preferred embodiments, the cyan dye-forming coupler comprises a phenol or naphthol compound which forms a cyan dye on reaction with an oxidized color developing agent. For example, the cyan dye-forming coupler may be a compound selected from the following formulae:

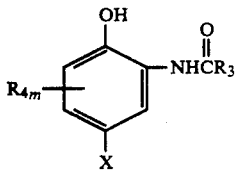

C-A

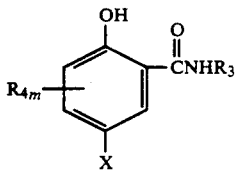

C-B

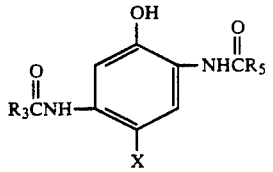

C-C

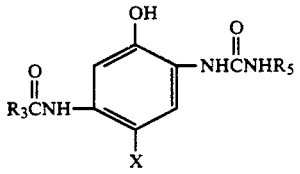

C-D

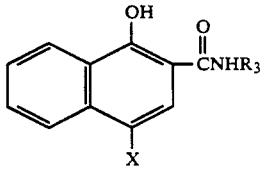

C-E wherein m is from 1 to 3, and $R_3$ is a ballast substituent having at least 10 carbon atoms, or a group which links to a polymer forming a so-called polymeric coupler. Ballast substituents include alkyl, substituted alkyl, aryl and substituted aryl groups. Each $R_4$ is individually selected from hydrogen, halogens (e.g., chloro, fluoro), alkyl groups of 1 to 4 carbon atoms and alkoxy groups of 1 to 4 carbon atoms. $R_5$ is selected from the group consisting of substituted and unsubstituted alkyl and aryl groups, wherein the substituents comprise one or more electron-withdrawing substituents, for example, cyano, halogen, methylsulfonyl or trifluoromethyl groups.

X is hydrogen or a coupling-off group. Coupling-off groups are well known to those skilled in the art. Generally, such groups determine the equivalency of the coupler and modify the reactivity of the coupler. Coupling-off groups can also advantageously affect the layer in which the coupler is coated or other layers in the photographic material by performing, after release from the coupler, such functions as development inhibition, bleach acceleration, color correction, development acceleration and the like. Representative coupling-off groups X include halogens (for example, chloro), alkoxy, aryloxy, alkylthio, arylthio, acyloxy, sulfonamido, carbonamido, arylazo, nitrogen-containing heterocyclic groups such as pyrazolyl and imidazolyl, and imido groups such as succinimido and hydantoinyl groups. Except for the halogens, these groups may be substituted if desired. Coupling-off groups are described in further detail in U.S. Pat. Nos. 2,355,169; 3,227,551; 3,432,521; 3,476,563; 3,617,291; 3,880,661; 4,052,212 and 4,134,766, and in British Patent Publication Nos. 1,466,728; 1,531,927; 1,533,039; 2,006,755A and 2,017,704A, the disclosures of which are incorporated herein by reference.

A coupler compound should be nondiffusible when incorporated in a photographic element. That is, the coupler compound should be of such a molecular size and configuration that it will exhibit substantially no diffusion from the layer in which it is coated. In order to ensure that the coupler compound is nondiffusible, the substituent $R_3$ should contain at least 10 carbon atoms, or should be a group which is linked to or forms part of a polymer chain.

Couplers which form yellow dyes upon reaction with an oxidized color developing agent are described in such representative patents and publications as U.S. Pat. Nos. 3,384,657; 3,415,652; 3,542,840; 4,046,575; 3,894,875; 4,095,983; 4,182,630; 2,875,057; 2,407,210; 3,265,506; 2,298,443; 3,408,194; 3,447,928; 4,587,207; 4,617,256; 4,587,205; 4,529,691; 4,443,536; 4,326,024; 4,203,768; 4,221,860; 3,933,501; 4,022,620; 4,401,752; European Patent Application 296,793 and "Farbkupplereine Literaturübersicht," published in Agfa Mitteilungen, Band III, pp. 112–126 (1961), the disclosures of which are incorporated herein by reference. Preferably such yellow-dye forming couplers are acylacetamides, such as benzoylacetanilides (Y-A) and pivaloylacetanilides (Y-B):

Y-A

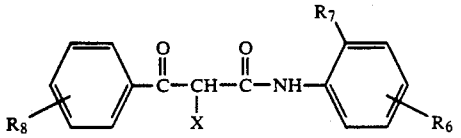

-continued

Y-B

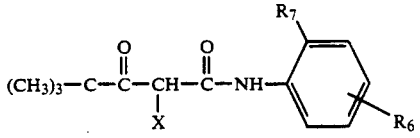

wherein $R_6$ is a ballast group having at least 10 carbon atoms, or may be hydrogen or a halogen if $R_7$ or $R_8$ contains sufficient ballast (≧10 carbon atoms), or may be a group which links to a polymer. $R_7$ may be hydrogen, halogen (e.g., a chlorine atom), an alkyl group, an alkoxy group or an aryloxy group. $R_8$ may be hydrogen, or one or more halogen (e.g., chlorine), alkyl or alkoxy groups or a ballast group. X is as defined above for cyan couplers. Ballast groups suitable for $R_6$ or $R_8$ include, for example, acyloxy groups, alkoxycarbonyl groups, aryloxycarbonyl groups, carbonamide groups, carbamoyl groups, sulfonamide groups and sulfamoyl groups which may themselves be substituted.

Specific examples of cyan dye-forming couplers useful for the practice of this invention include, but are not limited to compounds c-i to c-x below, which represent species based on generic formulas C-A to C-E above:

(c-i)

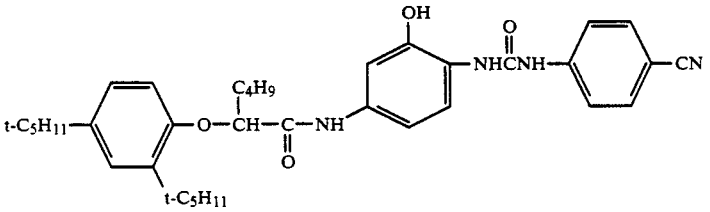

(c-ii)

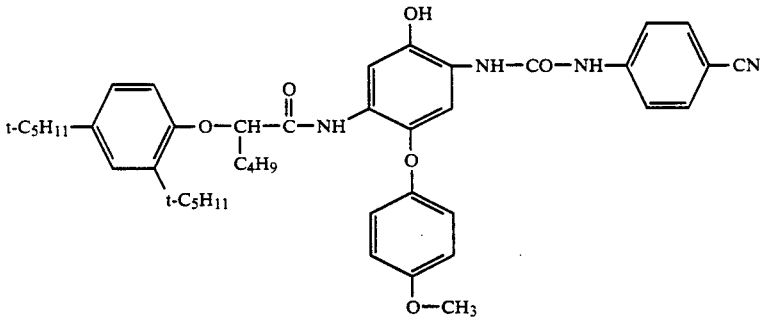

(c-iii)

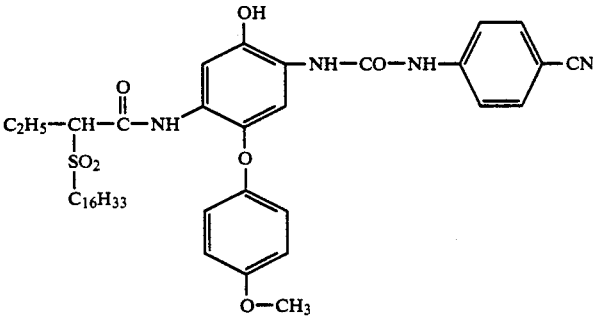

(c-iv)

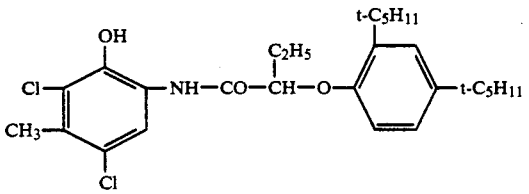

-continued
(c-v)
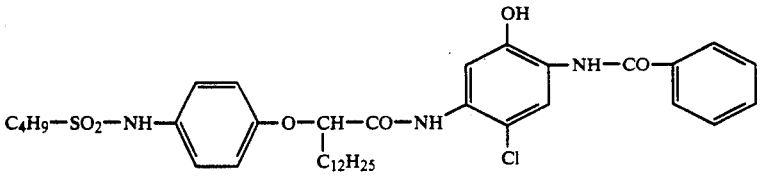
(c-vi)
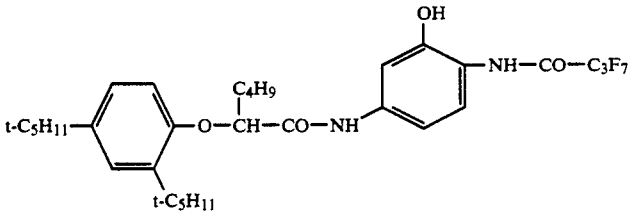
(c-vii)
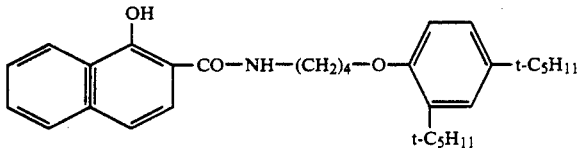
(c-viii)
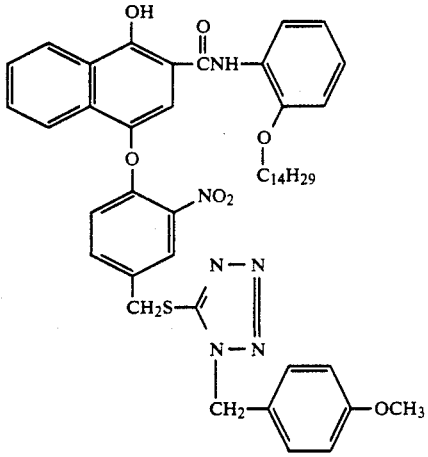
(c-ix)
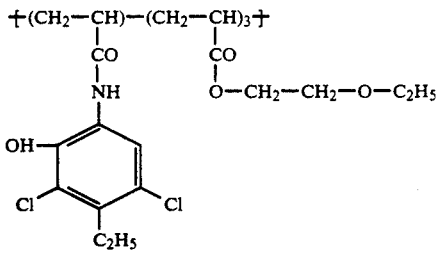
(c-x)
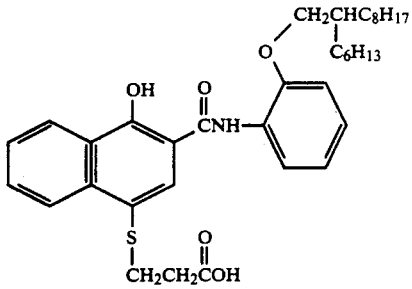
Specific examples of yellow dye-forming couplers useful for the practice of this invention include, but are not limited to compounds y-i to y-x below, which represent species based on generic formulas Y-A and Y-B above:

(y-i)
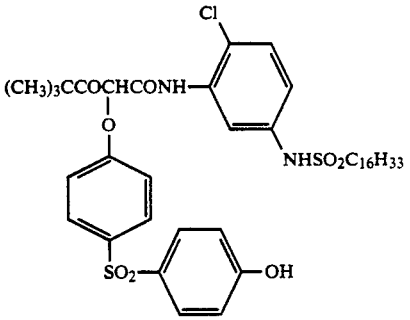
(y-ii)
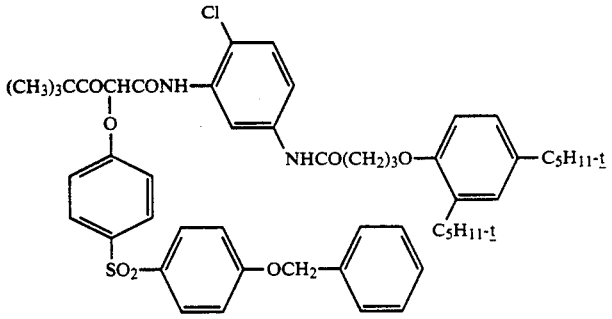
(y-iii)
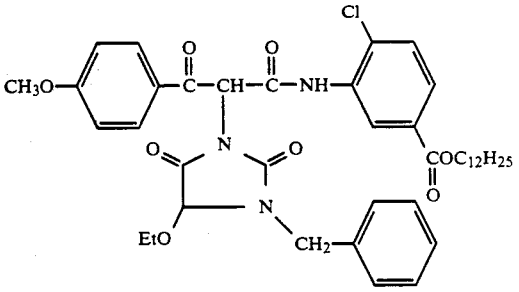
(y-iv)
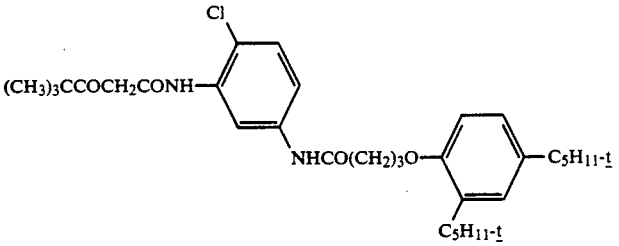
(y-v)
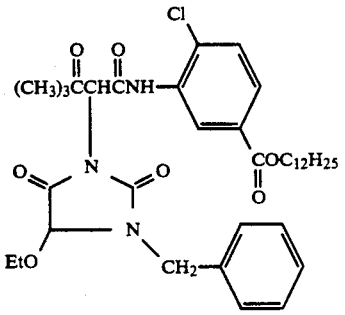

-continued
(y-vi)
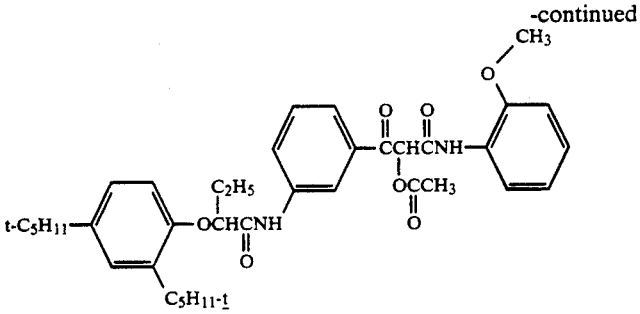
(y-vii)
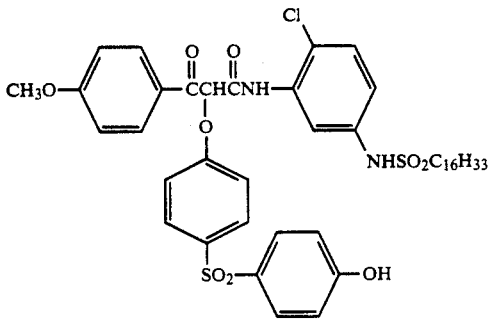
(y-viii)
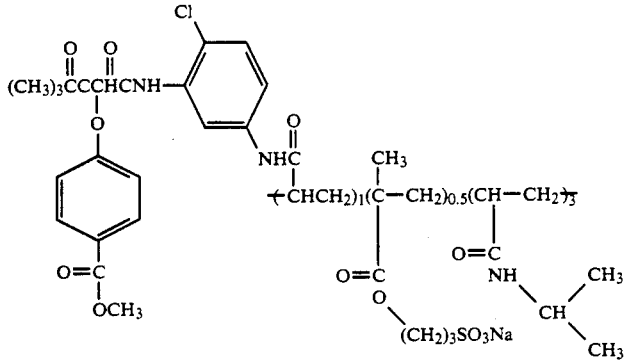
(y-ix)
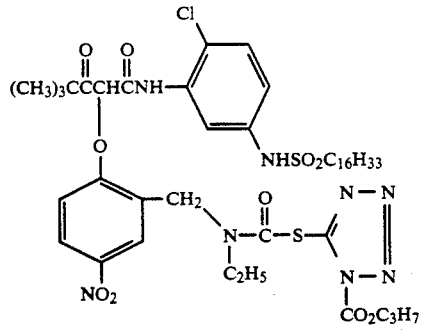
(y-x)
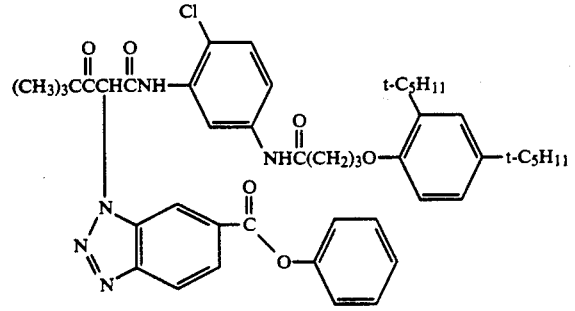
The spectral sensitizer used in the photosensitive element according to the invention depends on the desired color and structure of the element, e.g., the number of layers. Sensitizing dyes useful in the practice of the invention include those types noted in *Research Disclosure*, December 1989, Item 308119, p.933. Anionic sensitizing dyes, particularly heterocyclic mercapto compounds having anionic sulfonate groups, are preferred, insofar as staining has been a problem with such dyes.

Silver halide emulsions of the invention can also be spectrally sensitized with dyes from a variety of classes, including the polymethine dye class, which includes the cyanines, merocyanines, complex cyanines and merocyanines (i.e., tri-, tetra-, and polynuclear cyanines and merocyanines), oxonols, hemioxonols, styryls, merostyryls, and streptocyanines. Illustrative spectral sensitizing dyes are disclosed in *Research Disclosure*, cited above, Item 17643, Section IV.

The sulfoxide compound may also be used in combination with polymeric addenda. With respect to the use of sulfoxides in combination with polymers, Example 2 below demonstrates that further reduction in retained sensitizing dye can be obtained by using polymeric addenda and sulfoxide coupler solvents in combination. The polymer preferably is incorporated in the element in the same layer as the silver halide emulsion. It can be present in an amount that will vary depending upon the particular effect desired.

Polymers useful for the practice of this invention are disclosed in commonly-assigned U.S. patent application No. 07/691,576, filed Apr. 25, 1991, a continuation-in-part of U.S. patent application No. 07/531,827, filed Jun. 1, 1990, by inventors Edward Schofield and Tien-The Chen, the entire contents of both applications being incorporated herein by reference. Such a copolymer for incorporation into a spectrally sensitized silver halide color photographic element comprises (a) repeating units derived from a methoxy-or ethoxy-containing acrylate or acrylamide monomer, copolymerized with (b) a different methoxy-or ethoxy-containing acrylate monomer represented by the structure:

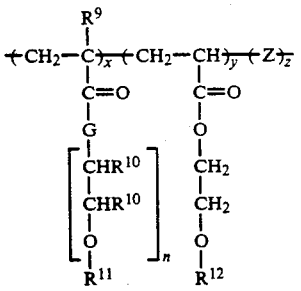

wherein

Z is the residue of one or more vinyl monomers,

G is —O—or —NH—, $R^9$ is —H or —$CH_3$, $R^{10}$ is —H or —$CH_3$, no more than one $R^{10}$ being —$CH_3$, $R^{11}$ and $R^{12}$ are —$CH_3$ or —$C_2H_5$, x is 15 to 90 weight percent, y is 0 to 90 weight percent, z is 0 to 85 weight percent, and n is 1 to 20, but if y=0, z must be ≧10.

In a preferred embodiment, the repeating units represented by Z are derived from one or more acid- or salt-containing vinyl monomers. In particular, one of $R^{11}$ and $R^{12}$ is methyl and the other is ethyl.

Examples of monomers useful in preparing polymers of this invention are methoxyethylacrylate or methacrylate, ethoxyethylacrylate or methacrylate, methoxyethoxyethyl-acrylate or methacrylate, methoxyethylacrylamide or methacrylamide, ethoxyethylacrylamide or methacrylamide, butyl acrylate, acrylic acid, methacrylic acid, hydroxyethylmethacrylate, hydroxyethylmethacrylamide, 2-methyl-2-[(1)-oxo-2-propenyl-)amino]-1-propane sulfonic acid, or its alkali metal salt, polypropyleneglycol monomethacrylate, polypropylene glycol monomethacrylamide. The polypropylene glycol monomers contain from 1 to 20 glycol units. The copolymers useful in the invention are free of repeating units containing dye-forming coupler moieties.

Copolymers containing methoxyethylacrylate, methoxyethylacrylamide or methacrylamide are especially preferred. Highly preferred polymers useful in this invention can be represented by the structure:

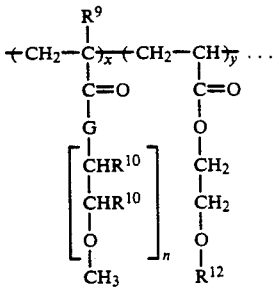

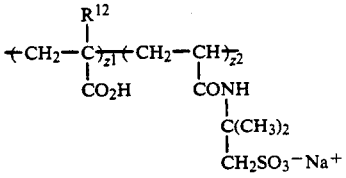

wherein

G, $R^9$, $R^{10}$ and $R^{12}$ are as defined above, x is 35 to 85 weight percent, y is 10 to 60 weight percent, $z^1$ is 3 to 10 weight percent, $z^2$ is 2 to 5 weight percent, and n is 1 to 20.

These polymers can be prepared by known polymerization processes, such as emulsion and solution polymerization, using known starting materials. Polymers prepared by emulsion polymerization can be mixed with gelatin and coated directly. Polymers prepared by solution polymerization can be dispersed in two different ways. The first way is to disperse the polymer in the same way that a ballasted coupler is dispersed, with or without a coupler solvent. The thus-formed dispersion is mixed with gelatin and coated. The second way is to disperse the polymer directly into water if enough units derived from ionizable monomers are present. The dispersion obtained is then mixed with gelatin and coated.

A photographic element of the invention generally comprises at least one layer containing a conventional silver halide photosensitive emulsion such as AgCl, AgBr, AgI, AgBrI or the like, in combination with a dye-forming coupler. The photographic coupler plus sulfoxide compositions of the invention are employed in color photographic materials in a manner well known in the photographic art. For example, a supporting substrate may be coated with a silver halide emulsion and a coupler plus sulfoxide composition of the invention. The photographic material may then be imagewise exposed and then developed in a solution containing a primary aromatic amine color developing agent. As further known in the art, the primary aromatic amine developing agent is oxidized in an imagewise manner by reaction with exposed silver halide grains, and the oxidized developer reacts with coupler to form dye. The development step is followed by bleaching and fixing steps or a bleach-fix step to remove silver and silver halide from the coating.

Additional couplers and/or addenda may be coated in the said layer as the couplers and sulfoxides of this invention. Couplers likely to be used in combination with the couplers of this invention include inhibitor releasing couplers, commonly referred to as DIR couplers, and switched or timed inhibitor releasing couplers, referred to as DIAR couplers, such as those described in U.S. Pat. Nos. 3,148,062, 3,227,554, 3,733,201, 4,409,323 and 4,248,962. The couplers of this invention may also be used in combination with so-called masking couplers or with bleach accelerator releasing couplers (BARCs) as further described below and in Item 308119 in *Research Disclosure*, December 1989, page 993.

Photographic materials in which the coupler plus sulfoxide compositions of this invention are incorporated may be simple elements or multilayer, multicolor elements. Multicolor elements contain dye image-forming units sensitive to each of the primary regions of the spectrum. Each unit can be comprised of a single emulsion layer or of multiple emulsion layers sensitive to a given region of the spectrum. The layers of the element and the layers of the unit can be arranged in various orders, as known in the art. The coupler plus sulfoxide compositions of this invention may be coated on a transparent support or a reflective support, such as a paper support, and may be used in color negative, reversal or color print materials.

A typical multicolor photographic element of the invention comprises a support bearing a cyan dye image-forming unit comprising at least one red-sensitive silver halide emulsion layer having associated therewith at least one cyan dye-forming coupler, a magenta image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at lest one yellow dye-forming coupler. The element can contain additional layers, such as filter layers, interlayers, overcoat layers, subbing layers, and the like. The element typically will have a total thickness (excluding the support) of from 5 to 30 microns.

In the following discussion of suitable materials for use in the elements of this invention, reference will be made to *Research Disclosure*, December 1978, Item 17643, and December 1989, Item No. 308119 published by Kenneth Mason publications, Ltd., Dudley Annex, 12a North Street, Emsworth, Hampshire P010 7DQ, ENGLAND, the disclosures of which are incorporated herein by reference. The elements of the invention can comprise emulsions and addenda described in these publications and in publications referenced in these publications.

The silver halide emulsions employed in the elements of this invention can be comprised of silver bromide, silver chloride, silver iodide, silver chlorobromide, silver chloroiodide, silver bromoiodide, silver chlorobromoiodide or mixtures thereof. The emulsions can include silver halide grains of any conventional shape or size. Specifically, the emulsions can include coarse, medium or fine silver halide grains. High aspect ratio tabular grain emulsions are specifically contemplated, such as those disclosed by Wilgus et al U.S. Pat. No. 4,434,226, Daubendiek et al U.S. Pat. No. 4,424,310, Wey U.S. Pat. No. 4,399,215, Solberg et al U.S. Pat. No. 4,433,048, Mignot U.S. Pat. No. 4,386,156, Evans et al U.S. Pat. No. 4,504,570, Maskasky U.S. Pat. No. 4,400,463, Wey et al U.S. Pat. No. 4,414,306, Maskasky U.S. Pat. Nos. 4,435,501 and 4,414,966 and Daubendiek et al U.S. Pat. Nos. 4,672,027 and 4,693,964. Also specifically contemplated are those silver bromoiodide grains with a higher molar proportion of iodide in the core of the grain than in the periphery of the grain, such as those described in GB 1,027,146; JA 54/48,521; U.S. Pat. Nos. 4,379,837, 4,444,877; 4,665,012; 4,686,178; 4,565,778; 4,728,602; 4,668,614 and 4,636,461; and in EP 264,954. The silver halide emulsions can be either monodisperse or polydisperse as precipitated. The grain size distribution of the emulsions can be controlled by silver halide grain separation techniques or by blending silver halide emulsions of differing grain sizes. Sensitizing compounds, such as compounds of copper, thallium, lead, bismuth, cadmium and group VIII noble metals, can be present during precipitation of the silver halide emulsion.

The emulsions can be surface-sensitive emulsions, i.e., emulsions that form latent images primarily on the surfaces of the silver halide grains, or internal latent image-forming emulsions, i.e., emulsions that form latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

The silver halide emulsions can be surface sensitized. Noble metal (e.g., gold), middle chalcogen (e.g., sulfur, selenium, or tellurium), and reduction sensitizers, employed individually or in combination, are specifically contemplated. Typical chemical sensitizers are listed in *Research Disclosure*, Item 17643, cited above, Section III.

Suitable vehicles for the emulsions layers and other layers of elements of this invention are described in Research Disclosure Item 17643, Section IX and the publications cited therein. The photographic elements can be coated on a variety of supports as described in *Research Disclosure*, Section XVII and the references described therein.

In addition to the couplers described herein, the elements of this invention can include additional couplers as described in *Research Disclosure* Section VII, paragraphs D, E, F and G and the publications cited therein. These additional couplers can be incorporated as described in *Research Disclosure*, Section VII, paragraph C and the publications cited therein. The coupler combinations of this invention can be used with colored masking couplers as described in U.S. Pat. No. 4,883,746 or with couplers that release bleach accelerators as described in European Patent Application 193,389.

The photographic elements of this invention can contain brighteners (*Research Disclosure*, Section V), antifoggants and stabilizers (*Research Disclosure* Section VI), antistain agents and image dye stabilizer (*Research Disclosure* Section VII, paragraphs I and J), light absorbing and scattering materials (Section VIII), hardeners (Section XI), plasticizers and lubricants (Section XII), antistatic agents (Section XIII), matting agents (Sections XII and XVI) and development modifiers (Section XXI).

Photographic elements can be exposed to actinic radiation, typically in the visible region of the spectrum, to form a latent image and then processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

Preferred color developing agents are p-phenylenediamines. Especially preferred are 4-amino-3-methyl-N,N-diethylaniline hydrochloride, 4-amino-3-methyl-N-ethyl-N-β-(methanesulfonamido)-ethylaniline sulfate hydrate, 4-amino-3-methyl-N-ethyl-N-β-hydroxyethylaniline sulfate, 4-amino-3-β-(methanesulfonamido)ethyl-N,N-diethylaniline hydrochloride and 4-amino-N-ethyl-N-(2-methoxy-ethyl)-m-toluidine di-p-toluenesulfonic acid.

With negative-working silver halide, the processing step described above provides a negative image. The described elements are preferably processed in the known C-41 color process as described in, for example, the *British Journal of Photography Annual of* 1988. pages 196–198. To provide a positive (or reversal) image, the color development step can be preceded by development with a non-chromogenic developing agent to develop exposed silver halide, but not form dye, and then uniformly fogging the element to render unexposed silver halide developable. Alternatively, a direct positive emulsion can be employed to obtain a positive image. Development is followed by the conventional steps of bleaching, fixing, or bleach-fixing, to remove silver or silver halide, washing, and drying.

The compositions and methods of the invention are demonstrated by the following examples, in which references are to parts by weight unless otherwise specified. In these examples, S1 refers to the comparative conventional coupler solvent consisting of a mixture of tritolyl phosphates, S2 refers to the conventional coupler solvent dibutyl phthalate, S3 refers to 1,4-cyclohexylene dimethylene bis(2-ethylhexanoate), and Roman numerals refer to sulfoxide solvents according to the invention as designated above.

EXAMPLE 1

Dispersions of the cyan dye-forming coupler c-i were prepared in a series of coupler solvents as follows. An oil phase was prepared by warming a mixture of 2.0 g of coupler, 2.0 g of coupler solvent (1:1) and 6.0 g of the auxiliary solvent cyclohexanone until dissolution was complete. This solution was added to an aqueous phase consisting of 19.2 g of 12.5% aqueous gelatin, 2.4 g of aqueous 10% ALKANOL XC TM and 8.4 g of water. The oil phase was dispersed by pouring the mixture through a colloid mill.

Coupler dispersions were then coated on acetate support at a laydown of $1.39\times10^{-4}$ moles/ft$^2$ (83.2 mg/ft$^2$) of c-i, together with a dye-sensitized tabular grain silver bromoiodide emulsion (3% iodide). The auxiliary solvent evaporated on coating. The resulting photosensitive layer had laydown amounts as follows:

| | |
|---|---|
| Gelatin | 300 mg/ft$^2$ |
| Coupler c-i | 83.2 mg/ft$^2$ |
| Coupler Solvent | 83.2 mg/ft$^2$ |
| Silver Halide Emulsion | 150 mg Ag/ft$^2$ |

A protective layer of gelatin (200 mg/ft$^2$) and a bis(-vinylsufonyl)methane hardener at 1.75% of total gelatin in the protective layer was then overcoated on the photosensitive layer. The silver halide emulsion used had been spectrally sensitized with dye A, shown below:

A

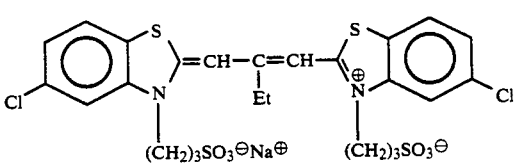

Film strips were exposed and subjected to the KODAK C-41 FLEXACOLOR process (see citation above) Coupler solvent dispersions were prepared by milling under the following conditions:

| Solution | Time | Temp | Agitation |
|---|---|---|---|
| KF12 Developer | 3' 15" | 100° F. | $N_2$ Burst |
| Flexicolor Bleach | 4' | " | Air |
| Wash | 3' | " | None |
| KF12 fix | 4' | " | $N_2$ |
| Wash | 4' | " | None |

Retained sensitizing dye in unexposed (Dmin) areas of film strips was extracted and analyzed by high performance liquid chromatography (HPLC). The % dye remaining int he film samples with various coupler solvents is listed in Table 1. The reduction in retained dye in sulfoxide II relative to S1, S2 and S3 is evident.

TABLE 1

| Coupler Solvent | % Dye A Retained |
|---|---|
| S1 | 88.8 |
| S2 | 91.0 |
| S3 | 92.8 |
| II | 67.7 |

EXAMPLE 2

Dispersion of the cyan dye-forming coupler c-i were prepared in a series of coupler solvents and incorporated into the polymer B:

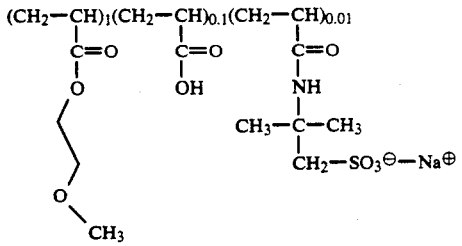

Coupler solvent dispersions were prepared by milling 3.0 g of coupler solvent and 1.1 g of ethyl acetate with 15 ml of 12.5% aqueous gelatin, 1.9 ml of 10% aqueous ALKANOL XC TM and 9.1 ml of water. The various coupler solvent dispersions were added to a mixture containing a c-i dispersion, latex polymer B, gelatin, spreading agent and tetraazaindine in quantities required to yield coated levels as indicated below. The mixtures were stirred for three hours at 40° C. to achieve intermixing of the coupler, coupler solvent and polymer.

The silver halide emulsion sensitized with dye A referred to in Example 1 was added to the mixtures in the necessary amount prior to coating on an acetate support as in Example 1. The resulting photosensitive layer had laydown amounts as follows:

| | |
|---|---|
| Gelatin | 300 mg/ft$^2$ |
| Coupler c-i | 83.2 mg/ft$^2$ |
| Coupler solvent | 83.2 mg/ft$^2$ |
| Polymer B | 41.5 mg/ft$^2$ |
| Silver Halide Emulsion | 150 mg Ag/ft$^2$ |

A protective layer of gelatin (200 mg/ft$^2$) and a bis(-vinylsufonyl)methane hardener at 1.75% of total gelatin in the protective layer was then overcoated on the photosensitive layer.

Film strips were exposed and processed (C-41), and retained sensitizing dye was analyzed as in the previous example. The data in Table 2 illustrates the reduction in retained sensitizing dye that is obtained by the combination of polymers such as B with sulfoxide coupler solvents such as II.

TABLE 2

| Dispersion | % Dye A Retained |
|---|---|
| c-i + B (no additional solvent) | 16.0 |
| c-i + B + S1 | 4.8 |
| c-i + B + S2 | 8.2 |
| c-i + B + S3 | 6.1 |
| c-i + B + II | 3.2 |

EXAMPLE 3

In this example, dispersions of the yellow dye-forming coupler y-i were prepared in a series of coupler solvents in a manner similar to the procedure used in Example 1. In this case, ethyl acetate was used as the auxiliary solvent and the weight ratio of coupler to coupler solvent to ethyl acetate was 1:0.5:3. The dispersions of coupler y-i were coated on acetate support at a coupler laydown of 150 mg/ft$^2$ (0.186 mmoles/ft$^2$), together with a 0.2 micron silver chloride emulsion sensitized with dye C:

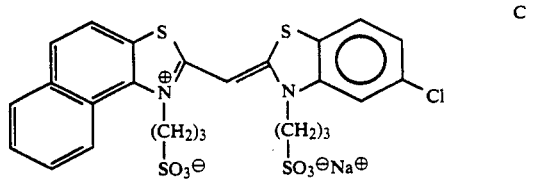

The resulting photosensitive layer had laydown amounts as follows:

| | |
|---|---|
| Gelatin | 350 mg/ft$^2$ |
| Coupler y-i | 150 mg/ft$^2$ |
| Coupler Solvent | 75 mg/ft$^2$ |
| Silver Halide Emulsion | 140 mg Ag/ft$^2$ |

A layer of gelatin (250 mg/ft$^2$) and a bis(vinylsufonyl) methane hardener in an amount of 1.85% of total gelatin was then overcoated on the photosensitive layer.

Film strips were exposed and processed as described in Example 1, and retained sensitizing dye was measured by HPLC analysis of film extracts. Table 3 lists reductions in sensitizing dye in unexposed (Dmin) areas of the films containing the various coupler solvents. More of the sensitizing dye was removed in the films containing sulfoxides II or III than in the films containing the comparative coupler solvents S1, S2 or S3.

TABLE 3

| Coupler Solvent | Mg/ft$^2$ of Dye C Removed |
|---|---|
| S1 | 0.19 |
| S2 | 0.15 |
| S3 | 0.15 |
| II | 0.23 |
| III | 0.20 |

It will be understood that the foregoing description is of preferred exemplary embodiments of the invention, and that the invention is not limited to the specific forms shown. Modifications may be made in the compositions of the invention without departing from the scope of the invention as expressed in the appended claims.

We claim:

1. A method of forming color in a silver halide photographic element wherein the silver halide is sensitized with a dye, which comprises reacting an oxidized developing agent with a phenolic or naphtholic cyan dye-forming coupler in a sulfoxide coupler solvent having the formula:

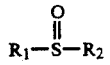

wherein $R_1$ and $R_2$ are individually selected from the group consisting of straight and branched chain alkyl groups, alkylene groups and alkenyl groups, any of which may be substituted with one or more substituents selected from the group consisting of alkoxy, aryloxy, aryl, alkoxycarbonyl, aryloxycarbonyl, acyloxy, carbonamido and carbamoyl groups, and halogen atoms; a phenyl group; and a phenyl group having at least one substituent selected from alkyl, alkoxy, aryloxy, aryl, alkoxycarbonyl, aryloxycarbonyl, acyloxy, carbonamido and carbamoyl groups and halogen atoms; and wherein $R_1$ and $R_2$ combined have at least 12 carbon atoms.

2. The method of claim 1, wherein $R_1$ and $R_2$ combined have from 12 to 26 carbon atoms.

3. The method of claim 2, wherein $R_1$ and $R_2$ are selected from unsubstituted straight and branched chain alkyl groups, alkenyl groups and alkylene groups.

4. The method of claim 2, wherein the coupler and the sulfoxide compound are employed in a weight ratio of from about 1:0.1 to a bout 1:10.

5. The method of claim 1, wherein the coupler is a cyan dye-forming coupler of the following formulae:

C-A

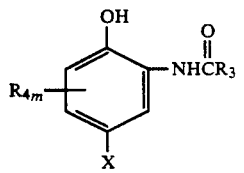

C-B

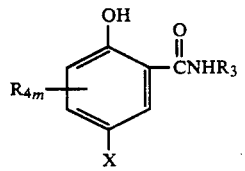

C-C

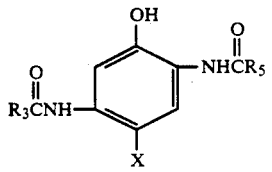

C-D

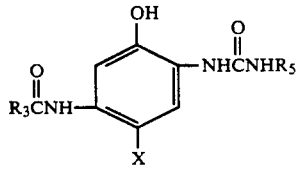

C-E

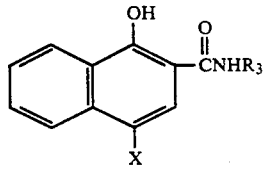

wherein m is from 1 to 3; $R_3$ is an alkyl, substituted alkyl, aryl and substituted aryl group, or a group which links to a organic polymer; each $R_4$ is individually selected from hydrogen, halogen, alkyl groups of 1 to 4 carbon atoms and alkoxy groups of 1 to 4 carbon atoms; $R_5$ is selected from substituted and unsubstituted alkyl and aryl groups, wherein the substituents comprise one or more electron-withdrawing substituents; and X is hydrogen or a substituted or unsubstituted coupling-off group selected from halogen, alkoxy, aryloxy, alkylthio, arylthio, acyloxy, sulfonamido, carbonamido, arylazo, nitrogen-containing heterocyclic groups, and imido groups groups.

6. The method of claim 5, wherein $R_5$ is an alkyl or aryl group substituted with one or more of cyano, halogen, methylsulfonyl or trifluoromethyl groups.

7. The method of claim 6, wherein x is hydrogen.

8. The method of claim 1, wherein the sulfoxide coupler solvent is used in an amount effective to reduce sensitizer dye staining caused by residual dye retained after processing of the photographic element.

9. The method of claim 8, wherein the dye consists essentially of an anionic dye containing an anionic sulfonate group.

10. The method of claim 9, wherein the dye consists essentially of a heterocyclic mercapto compound.

11. A method of forming color in a silver halide photographic element wherein the silver halide is sensitized with a dye, which comprises reacting an oxidized developing agent with an acylacetamide yellow-dye-forming coupler in a sulfoxide coupler solvent having the formula:

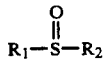

wherein $R_1$ and $R_2$ are individually selected from the group consisting of straight and branched chain alkyl groups, alkylene groups and alkenyl groups, any of which may be substituted with one or more substituents selected from the group consisting of alkoxy, aryloxy, aryl, alkoxycarbonyl, aryloxycarbonyl, acyloxy, carbonamido and carbamoyl groups, and halogen atoms; a phenyl group; and a phenyl group having at least one substituent selected from alkyl, alkoxy, aryloxy, aryl, alkoxycarbonyl, aryloxycarbonyl, acyloxy, carbonamido and carbamoyl groups and halogen atoms; and wherein $R_1$ and $R_2$ combined have at least 12 carbon atoms.

12. The method of claim 11, wherein $R_1$ and $R_2$ combined have from 12 to 26 carbon atoms.

13. The method of claim 12, wherein $R_1$ and $R_2$ are selected from unsubstituted straight and branched chain alkyl groups, alkenyl groups and alkylene groups.

14. The method of claim 11, wherein the coupler and the sulfoxide compound are employed in a weight ratio of from about 1:0.1 to about 1:10.

15. The method of claim 11, wherein the coupler is a yellow dye-forming coupler of the formula:

Y-A

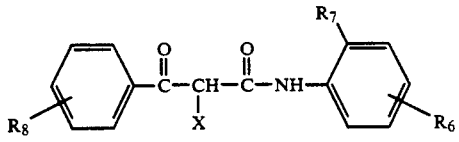

Y-B

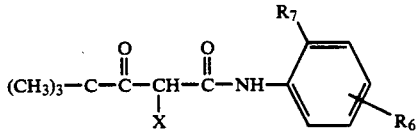

wherein $R_6$ is a ballast group having at least 10 carbon atoms, or may be hydrogen or a halogen if $R_7$ or $R_8$ contains has at least 10 carbon atoms, or may be a group which links to a polymer, $R_7$ may be hydrogen, halogen, an alkyl group, an alkoxy group or an aryloxy group, $R_8$ may be hydrogen, halogen, alkyl or alkoxy group or a ballast group having at least 10 carbon atoms, and X is hydrogen or a substituted or unsubstituted coupling-off group selected from halogen, alkoxy, aryloxy, alkyl thio, aryl thio, acyloxy, sulfonamido, carbonamido, arylazo, nitrogen-containing heterocyclic groups, and imido groups.

16. The method of claim 15, wherein ballast groups for $R_6$ or $R_8$, which may be the same or different, are selected from substituted or unsubstituted acyloxy, alkoxycarbonyl, aryloxycarbonyl, carbonamide, carbamoyl, sulfonamide, and sulfamoyl groups.

17. The method of claim 11, wherein the sulfoxide coupler solvent is used in an amount effective to reduce sensitizer dye staining caused by residual dye retained after processing of the photographic element.

18. The method of claim 17, wherein the dye consists essentially of an anionic dye containing an anionic sulfonate group.

19. The method of claim 18, wherein the dye consists essentially of a heterocyclic mercapto compound.

20. In a photosensitive element comprising a layer of a silver halide photosensitive emulsion disposed on a support in combination with a dye-forming coupler which reacts with an oxidized developing agent to form a colored image which corresponds to a pattern of exposure of the silver halide, the improvement which comprises:

the silver halide is sensitized with dye, and said photosensitive layer contains a phenolic or naphtholic cyan dye-forming coupler in a sulfoxide solvent having the formula:

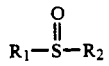

wherein $R_1$ and $R_2$ are individually selected from the group consisting of straight and branched chain alkyl groups, alkylene groups and alkenyl groups, any of which may be substituted with one or more substituents selected from the group consisting of alkoxy, aryloxy, aryl, alkoxycarbonyl, aryloxycarbonyl, acyloxy, carbonamido and carbamoyl groups, and halogen atoms; a phenyl group; and a phenyl group having at least one substituent selected from alkyl, alkoxy, aryloxy, aryl, alkoxycarbonyl, aryloxycarbonyl, acyloxy, carbonamido and carbamoyl groups and halogen atoms; and wherein $R_1$ and $R_2$ combined have at least 12 carbon atoms.

21. The photosensitive element of claim 20, wherein $R_1$ and $R_2$ combined have from 12 to 26 carbon atoms, and wherein $R_1$ and $R_2$ are selected from unsubstituted straight and branched chain alkyl groups, alkenyl groups and alkylene groups.

22. The photosensitive element of claim 20, wherein the coupler and the sulfoxide compound are employed in a weight ratio of from about 1:0.1 to about 1:10.

23. The photosensitive element of claim 20, wherein the sulfoxide coupler solvent is used in an amount effective to reduce sensitizer dye staining caused by residual dye retained after processing of the photosensitive element.

24. The photosensitive element of claim 23, wherein the dye consists essentially of an anionic dye containing an anionic sulfonate group.

25. The photosensitive element of claim 24, wherein the dye consists essentially of a heterocyclic mercapto compound.

26. In a photosensitive element comprising a layer of a silver halide photosensitive emulsion disposed on a support in combination with a dye-forming coupler which reacts with an oxidized developing agent to form a colored image which corresponds to a pattern of exposure of the silver halide, the improvement which comprises:

the silver halide is sensitized with dye, and said photosensitive layer contains a acylacetamide yellow dye-forming coupler in a sulfoxide solvent having the formula:

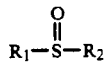

wherein $R_1$ and $R_2$ are individually selected from the group consisting of straight and branched chain alkyl groups, alkylene groups and alkenyl groups, any of which may be substituted with one or more substituents selected from the group consisting of alkoxy, aryloxy, aryl, alkoxycarbonyl, aryloxycarbonyl, acyloxy, carbonamido and carbamoyl groups, and halogen atoms; a phenyl group; and a phenyl group having at least one substituent selected from alkyl, alkoxy, aryloxy, aryl, alkoxycarbonyl, aryloxycarbonyl, acyloxy, carbonamido and carbamoyl groups and halogen atoms; and wherein $R_1$ and $R_2$ combined have at least 12 carbon atoms.

27. The photosensitive element of claim 26, wherein $R_1$ and $R_2$ combined have from 12 to 26 carbon atoms, and wherein $R_1$ and $R_2$ are selected from unsubstituted straight and branched chain alkyl groups, alkenyl groups and alkylene groups.

28. The photosensitive element of claim 26, wherein the coupler and the sulfoxide compound are employed in a weight ratio of from about 1:0.1 to about 1:10.

29. The photosensitive element of claim 26, wherein the sulfoxide coupler solvent is used in an amount effective to reduce sensitizer dye staining caused by residual dye retained after processing of the photosensitive element.

30. The photosensitive element of claim 29, wherein the dye consists essentially of an anionic dye containing an anionic sulfonate group.

31. The photosensitive element of claim 30, wherein the dye consists essentially of a heterocyclic mercapto compound.

* * * * *

UNITED STATES PATENT AND TRADEMARK OFFICE

CERTIFICATE OF CORRECTION

PATENT NO. : 5,192,646

DATED : March 9, 1993

INVENTOR(S) : Merkel et al.

It is certified that error appears in the above-identified patent and that said Letters Patent is hereby corrected as shown below:

Column 13, lines 32-33, change "Tien-The" to --Tien-Teh--.

Column 15, line 53, change "lest" to --least--.

Column 18, line 49, change "int he" to --in the--.

IN THE CLAIMS:

Claim 15, column 22, line 59, delete "contains".

Signed and Sealed this

Twenty-second Day of March, 1994

*Attest:*

Bruce Lehman

BRUCE LEHMAN

*Attesting Officer*

*Commissioner of Patents and Trademarks*